US009362634B2

(12) United States Patent
Davidson, Jr. et al.

(10) Patent No.: US 9,362,634 B2
(45) Date of Patent: Jun. 7, 2016

(54) ENHANCED CONTINUITY CONNECTOR

(71) Applicant: PerfectVision Manufacturing, Inc., Little Rock, AR (US)

(72) Inventors: Charles Darwin Davidson, Jr., Little Rock, AR (US); Glen David Shaw, Conway, AR (US)

(73) Assignee: PERFECTVISION MANUFACTURING, INC., Little Rock, AR (US)

( * ) Notice: Subject to any disclaimer, the term of this patent is extended or adjusted under 35 U.S.C. 154(b) by 0 days.

(21) Appl. No.: 14/626,896

(22) Filed: Feb. 19, 2015

(65) Prior Publication Data

US 2015/0162675 A1 Jun. 11, 2015

Related U.S. Application Data

(63) Continuation-in-part of application No. 14/035,872, filed on Sep. 24, 2014, now Pat. No. 9,039,445, which is a continuation-in-part of application No. 13/527,521, filed on Jun. 19, 2012, now abandoned, which is a continuation-in-part of application No. 13/374,378, filed on Dec. 27, 2011, now Pat. No. 8,636,541.

(51) Int. Cl.

| | |
|---|---|
| ***H01R 9/05*** | (2006.01) |
| ***H01R 13/52*** | (2006.01) |
| *H01R 13/03* | (2006.01) |

(52) U.S. Cl.

CPC ..... *H01R 9/0521* (2013.01); *H01R 9/0524* (2013.01); *H01R 13/5202* (2013.01); *H01R 13/035* (2013.01); *Y10T 29/49204* (2015.01)

(58) Field of Classification Search

CPC ..... H01R 9/0521; H01R 9/0524; H01R 9/05
See application file for complete search history.

(56) References Cited

U.S. PATENT DOCUMENTS

| | | | | | |
|---|---|---|---|---|---|
| 331,169 | A | * | 11/1885 | Thomas | F16B 39/24 411/165 |
| 523,878 | A | * | 7/1894 | Bickell | F16B 39/32 411/326 |
| 776,991 | A | * | 12/1904 | Blue | F16B 39/24 411/145 |
| 904,606 | A | * | 11/1908 | Dressler | F16B 39/24 411/133 |
| 920,947 | A | * | 5/1909 | Gilmore | F16B 39/24 411/145 |
| 997,359 | A | * | 7/1911 | Ammons | F16B 39/24 279/100 |
| 1,010,391 | A | * | 11/1911 | Lambie et al. | F16B 39/24 112/233 |
| 1,033,581 | A | * | 7/1912 | Hanchett et al. | F16B 39/32 411/331 |
| 1,033,585 | A | * | 7/1912 | Hickey et al. | F16B 39/24 411/133 |

(Continued)

FOREIGN PATENT DOCUMENTS

| | | |
|---|---|---|
| EP | 0542102 | 5/1993 |
| WO | WO9305547 | 3/1993 |

(Continued)

OTHER PUBLICATIONS

PCT International Inc, TRS Compression Connectors Installation Guide, Copyright Aug. 3, 2009, p. 10, PCT International, Inc., Mesa, Arizona.

(Continued)

*Primary Examiner* — Ross Gushi

(57) ABSTRACT

A male F-Type coaxial cable connector with a body prod, the body prod for urging a connector nut into contact with a connector post.

21 Claims, 10 Drawing Sheets

(56) References Cited

U.S. PATENT DOCUMENTS 1,267,695 A * 5/1918 Rich, Jr. ..... F16B 39/24 411/163
1,302,858 A * 5/1919 Sack ..... F16B 39/24 411/138
1,323,188 A * 11/1919 Humphris ..... F16B 39/24 411/148
1,349,404 A * 8/1920 Blake ..... F16B 39/24 411/126
1,368,604 A * 2/1921 Carmody ..... F16B 39/24 411/162
1,386,092 A * 8/1921 Cole ..... F16B 39/24 411/126
1,615,382 A * 1/1927 Hosking ..... F16B 39/24 411/165
1,715,777 A * 6/1929 Olson ..... F16B 39/24 411/161
1,726,972 A * 9/1929 Zinnbauer ..... F16B 39/24 411/163
1,740,113 A * 12/1929 Olson ..... F16B 39/24 411/163
1,749,600 A * 3/1930 Olson ..... F16B 39/108 174/51
1,865,132 A * 6/1932 Olson ..... F16B 43/00 411/148
1,878,425 A * 9/1932 Olson ..... F16B 39/24 411/154
1,885,761 A * 11/1932 Peirce, Jr. ..... F16B 39/24 411/162
1,891,563 A * 12/1932 Lillig ..... F16B 39/24 411/126
1,926,917 A * 9/1933 Rosenberg ..... F16B 39/24 411/154
2,041,568 A * 5/1936 Olson ..... F16B 39/24 411/164
2,102,495 A * 12/1937 England ..... F16B 39/24 411/164
2,228,217 A * 1/1941 Olson ..... F16B 39/24 411/154
2,250,050 A * 7/1941 Olson ..... F16B 39/26 411/165
2,257,479 A * 9/1941 Olson ..... B25B 27/00 411/162
2,370,912 A * 3/1945 Pierce ..... F16B 39/24 411/160
D148,897 S 3/1948 Hurlbut
2,557,288 A * 6/1951 Hosking ..... F16B 39/24 411/165
2,559,833 A * 7/1951 Stellin ..... F16B 39/24 411/163
2,757,351 A 7/1956 Klostermann
D181,302 S 10/1957 Logan
2,858,358 A 10/1958 Hawke
3,072,168 A * 1/1963 Beart ..... F16B 39/24 411/163
3,184,706 A 5/1965 Atkins
3,199,061 A 8/1965 Johnson
3,258,047 A * 6/1966 Loretan ..... F16B 39/24 411/136
3,275,055 A * 9/1966 Gutshall ..... F16B 39/24 411/134
3,292,136 A 12/1966 Somerset
3,332,052 A 7/1967 Rusinyak
3,352,344 A * 11/1967 Lanius, Jr. ..... F16B 39/24 411/145
3,373,243 A 3/1968 Janowiak
3,375,485 A 3/1968 Donohue
3,430,673 A * 3/1969 Rapata ..... F16B 39/24 411/134
3,448,430 A 6/1969 Kelly
3,498,647 A 3/1970 Schroder
3,512,224 A 5/1970 Newton
3,522,576 A 8/1970 Cairns
3,537,065 A 10/1970 Winston
3,609,637 A 9/1971 Cole
3,665,371 A 5/1972 Cripps
3,668,612 A 6/1972 Nepovim
3,671,922 A 6/1972 Zerlin
3,671,926 A 6/1972 Nepovim
3,678,445 A 7/1972 Brancaleone
3,678,446 A 7/1972 Siebelist
3,681,739 A 8/1972 Kornick
3,686,623 A 8/1972 Nijman
3,710,005 A 1/1973 French
3,739,076 A 6/1973 Schwartz
3,740,453 A 6/1973 Callaghan
3,835,442 A 9/1974 Anderson
3,835,443 A 9/1974 Arnold
3,846,738 A 11/1974 Nepovim
3,879,102 A 4/1975 Horak
3,976,352 A 8/1976 Spinner
D241,341 S 9/1976 Oxley
3,985,418 A 10/1976 Spinner
3,986,737 A 10/1976 Krusche
4,106,839 A 8/1978 Cooper
4,128,293 A 12/1978 Paoli
4,173,385 A 11/1979 Fenn
4,280,749 A 7/1981 Hemmer
4,329,540 A 5/1982 Howarth
4,330,166 A 5/1982 Cooper
4,359,254 A 11/1982 Gallusser
4,423,919 A 1/1984 Hillis
4,426,127 A 1/1984 Kubota
4,525,000 A 6/1985 Bachle
4,531,805 A 7/1985 Werth
4,583,811 A 4/1986 McMills
4,593,964 A 6/1986 Forney, Jr.
4,630,806 A 12/1986 Dan
4,648,684 A 3/1987 Mattis
4,684,201 A 8/1987 Hutter
4,698,028 A 10/1987 Caro
4,703,988 A 11/1987 Raux
4,746,305 A 5/1988 Nomura
RE32,787 E 11/1988 Gallusser
4,791,837 A 12/1988 Main
4,808,128 A 2/1989 Werth
4,813,716 A 3/1989 Lalikos
4,834,675 A 5/1989 Samchisen
4,936,788 A 6/1990 Lin
4,952,174 A 8/1990 Sucht
D313,222 S 12/1990 Takizawa
4,979,911 A 12/1990 Spencer
4,990,106 A 2/1991 Szegda
5,002,503 A 3/1991 Campbell
5,011,422 A 4/1991 Yeh
5,024,606 A 6/1991 Ming-Hwa
5,043,696 A 8/1991 Wang
5,066,248 A 11/1991 Gaver, Jr.
5,078,623 A 1/1992 Wang
5,083,943 A 1/1992 Tarrant
5,088,936 A 2/1992 Wang
5,112,250 A 5/1992 Wang
D327,872 S 7/1992 McMills
5,167,525 A 12/1992 Wang
5,167,536 A 12/1992 Wang
5,192,226 A 3/1993 Wang
5,219,299 A 6/1993 Wang
5,226,838 A 7/1993 Hsu
D339,568 S 9/1993 Salz
5,270,487 A 12/1993 Sawamura
5,297,458 A 3/1994 Smith
5,321,207 A 6/1994 Huang
5,340,325 A 8/1994 Pai
5,342,096 A 8/1994 Bachle
5,383,798 A 1/1995 Lin
5,387,116 A 2/1995 Wang
5,387,127 A 2/1995 Wang
5,389,012 A 2/1995 Huang
5,397,252 A 3/1995 Wang
5,413,502 A 5/1995 Wang
5,430,618 A 7/1995 Huang
5,438,251 A 8/1995 Chen
5,456,614 A 10/1995 Szegda
5,470,257 A 11/1995 Szegda
5,478,258 A 12/1995 Wang

(56) References Cited

U.S. PATENT DOCUMENTS 5,498,175 A 3/1996 Yeh
5,562,378 A * 10/1996 Blechschmidt ..... F16B 33/008 411/121
5,599,198 A 2/1997 Wang
5,600,094 A 2/1997 McCabe
5,613,880 A 3/1997 Wang
5,632,651 A 5/1997 Szegda
5,667,409 A 9/1997 Wong
5,683,263 A 11/1997 Hsu
5,702,261 A 12/1997 Wang
5,722,856 A 3/1998 Fuchs
5,723,818 A 3/1998 Yeh
5,730,621 A 3/1998 Wang
5,769,652 A 6/1998 Wider
D398,493 S 9/1998 Jones
5,803,757 A 9/1998 Wang
5,820,408 A 10/1998 Wang
5,863,226 A 1/1999 Lan
5,879,166 A 3/1999 Wang
5,879,191 A 3/1999 Burris
5,924,869 A 7/1999 Haas
5,924,889 A 7/1999 Wang
5,934,137 A 8/1999 Tarpill
5,951,319 A 9/1999 Lin
5,957,730 A 9/1999 Wang
5,975,949 A 11/1999 Holliday
5,975,951 A 11/1999 Burris
5,980,308 A 11/1999 Hu
5,997,350 A 12/1999 Burris
6,024,177 A * 2/2000 Winebrenner ..... A62C 31/28 169/37
6,024,588 A 2/2000 Hsu
6,065,976 A 5/2000 Wang
6,095,869 A 8/2000 Wang
6,113,431 A 9/2000 Wong
6,139,344 A 10/2000 Wang
6,146,197 A 11/2000 Holliday
6,152,665 A * 11/2000 Wallace ..... F16B 31/028 116/212
6,153,830 A 11/2000 Montena
6,159,046 A 12/2000 Wang
D436,076 S 1/2001 Montena
6,179,656 B1 1/2001 Wang
D437,826 S 2/2001 Montena
D440,539 S 4/2001 Montena
D440,939 S 4/2001 Montena
6,234,838 B1 5/2001 Wang
6,276,970 B1 8/2001 Wang
6,287,148 B1 9/2001 Huang
6,332,815 B1 12/2001 Bruce
6,386,912 B1 5/2002 Li
6,390,840 B1 5/2002 Wang
D458,904 S 6/2002 Montena
6,402,155 B2 6/2002 Sakata
6,406,330 B2 6/2002 Bruce
D460,739 S 7/2002 Fox
D461,166 S 8/2002 Montena
D461,167 S 8/2002 Montena
D461,778 S 8/2002 Fox
D462,058 S 8/2002 Montena
D462,060 S 8/2002 Fox
D462,327 S 9/2002 Montena
6,478,599 B1 11/2002 Lee
6,478,618 B2 11/2002 Wang
6,488,317 B1 12/2002 Daoud
D468,696 S 1/2003 Montena
6,530,807 B2 3/2003 Rodrigues
6,558,194 B2 5/2003 Montena
D475,975 S 6/2003 Fox
D475,976 S 6/2003 Montena
D475,977 S 6/2003 Montena
6,634,906 B1 10/2003 Yeh
6,676,443 B1 1/2004 Wang
6,716,062 B1 4/2004 Palinkas
6,733,336 B1 5/2004 Montena
6,767,247 B2 7/2004 Rodrigues
6,767,248 B1 7/2004 Hung
6,767,249 B1 7/2004 Li
6,769,926 B1 8/2004 Montena
6,776,650 B2 8/2004 Cheng
6,776,657 B1 8/2004 Hung
6,776,665 B2 8/2004 Huang
6,780,052 B2 8/2004 Montena
6,789,653 B1 9/2004 Hsu
6,793,526 B1 9/2004 Hsu
6,799,995 B2 10/2004 Hsu
6,805,584 B1 10/2004 Chen
6,817,897 B2 11/2004 Chee
6,830,479 B2 12/2004 Holliday
6,848,939 B2 2/2005 Stirling
6,848,940 B2 2/2005 Montena
6,860,751 B1 3/2005 Huang
D503,685 S 4/2005 Montena
D504,113 S 4/2005 Montena
D504,114 S 4/2005 Montena
D504,402 S 4/2005 Montena
6,881,075 B2 4/2005 Huang
6,884,113 B1 4/2005 Montena
D505,391 S 5/2005 Rodrigues
6,887,090 B2 5/2005 Lin
6,887,102 B1 5/2005 Burris
D506,446 S 6/2005 Montena
6,908,337 B1 6/2005 Li
6,910,919 B1 6/2005 Hung
D507,242 S 7/2005 Montena
6,929,501 B2 8/2005 Huang
6,929,507 B2 8/2005 Lin
6,935,874 B1 8/2005 Fang
6,935,878 B2 8/2005 Hsu
6,948,969 B2 9/2005 Huang
6,948,973 B1 9/2005 Hsu
6,951,469 B1 10/2005 Lin
6,956,464 B2 10/2005 Wang
D511,497 S 11/2005 Murphy
D511,498 S 11/2005 Holliday
D512,024 S 11/2005 Murphy
D512,689 S 12/2005 Murphy
D513,406 S 1/2006 Rodrigues
D513,736 S 1/2006 Fox
D514,071 S 1/2006 Vahey
D515,037 S 2/2006 Fox
6,994,588 B2 2/2006 Montena
7,001,204 B1 2/2006 Lin
7,004,765 B2 2/2006 Hsu
7,004,777 B2 2/2006 Hsu
7,008,263 B2 3/2006 Holland
7,011,547 B1 * 3/2006 Wu ..... H01R 9/0521 439/583
7,018,235 B1 3/2006 Burris
D518,772 S 4/2006 Fox
D519,076 S 4/2006 Fox
D519,451 S 4/2006 Fox
D519,452 S 4/2006 Rodrigues
D519,453 S 4/2006 Rodrigues
D519,463 S 4/2006 Tamezana
7,021,965 B1 4/2006 Montena
D521,454 S 5/2006 Murphy
D521,930 S 5/2006 Fox
7,063,551 B1 6/2006 Lin
7,074,081 B2 7/2006 Hsia
7,114,990 B2 10/2006 Bence
7,118,416 B2 10/2006 Montena
7,128,603 B2 10/2006 Burris
7,147,509 B1 12/2006 Burris
D535,259 S 1/2007 Rodrigues
7,182,639 B2 2/2007 Burris
7,191,687 B1 3/2007 Wadsley
7,192,308 B2 3/2007 Rodrigues
D543,948 S 6/2007 Montena
D544,837 S 6/2007 Disbennett
7,241,172 B2 7/2007 Rodrigues
7,252,546 B1 8/2007 Holland
7,255,598 B2 8/2007 Montena
7,288,002 B2 10/2007 Rodrigues

(56) References Cited

U.S. PATENT DOCUMENTS 7,303,436 B1 12/2007 Li
7,309,255 B2 12/2007 Rodrigues
7,364,462 B2 4/2008 Holland
7,371,113 B2 5/2008 Burris
7,479,035 B2 1/2009 Bence
7,507,117 B2 3/2009 Amidon
7,513,795 B1 * 4/2009 Shaw ..... H01R 9/0521 439/578
7,544,094 B1 6/2009 Paglia
7,566,236 B2 * 7/2009 Malloy ..... H01R 13/622 439/321
D601,966 S 10/2009 Shaw
D601,967 S 10/2009 Shaw
D607,826 S 1/2010 Shaw
D607,827 S 1/2010 Shaw
D607,828 S 1/2010 Shaw
D607,829 S 1/2010 Shaw
D607,830 S 1/2010 Shaw
D608,294 S 1/2010 Shaw
7,753,705 B2 7/2010 Montena
7,824,216 B2 11/2010 Purdy
7,837,501 B2 11/2010 Youtsey
7,841,896 B2 * 11/2010 Shaw ..... H01R 9/0521 439/578
7,845,976 B2 12/2010 Mathews
7,892,005 B2 * 2/2011 Haube ..... H01R 13/641 439/315
7,892,024 B1 2/2011 Chen
7,931,509 B2 4/2011 Shaw
7,946,199 B2 5/2011 Bradley
7,950,958 B2 5/2011 Mathews
7,955,126 B2 6/2011 Bence
7,997,930 B2 8/2011 Ehret
8,016,605 B2 9/2011 Montena
8,016,612 B2 9/2011 Burris
8,025,518 B2 9/2011 Burris
8,029,316 B2 10/2011 Snyder
8,062,064 B2 11/2011 Rodrigues
8,065,940 B2 11/2011 Wilson
8,075,338 B1 12/2011 Montena
8,113,875 B2 * 2/2012 Malloy ..... H01R 13/187 439/578
8,157,589 B2 4/2012 Krenceski
8,167,611 B2 5/2012 Nakano
8,167,646 B1 5/2012 Mathews
8,172,611 B1 5/2012 Montena
8,192,237 B2 * 6/2012 Purdy ..... H01R 9/0524 439/584
8,287,310 B2 10/2012 Burris
8,287,320 B2 * 10/2012 Purdy ..... H01R 9/0524 439/583
RE43,832 E * 11/2012 Malloy ..... H01R 13/622 439/321
8,303,357 B2 * 11/2012 Kuwahara ..... H01R 4/26 411/160
8,313,345 B2 11/2012 Purdy
8,313,353 B2 11/2012 Purdy
8,323,053 B2 12/2012 Montena
8,323,060 B2 12/2012 Purdy
8,366,481 B2 * 2/2013 Ehret ..... H01R 9/05 439/578
8,414,313 B2 4/2013 Rodrigues
8,444,433 B2 5/2013 Snyder
8,469,740 B2 6/2013 Ehret
8,475,205 B2 7/2013 Ehret
8,480,430 B2 7/2013 Ehret
8,480,431 B2 7/2013 Ehret
8,485,845 B2 7/2013 Ehret
8,490,525 B2 7/2013 Wilson
8,568,164 B2 10/2013 Ehret
2,280,728 A1 4/2014 Streib
8,794,113 B2 8/2014 Maury
8,845,254 B2 * 9/2014 Lee ..... F16B 39/24 411/145
2002/0146935 A1 10/2002 Wong
2003/0092319 A1 5/2003 Hung
2003/0186583 A1 * 10/2003 Yeh ..... H01R 9/0518 439/585
2003/0194902 A1 10/2003 Huang
2003/0236027 A1 12/2003 Wang
2004/0053533 A1 3/2004 Huang
2004/0067688 A1 4/2004 Cheng
2004/0077215 A1 4/2004 Palinkas
2004/0102095 A1 5/2004 Huang
2004/0147164 A1 7/2004 Li
2004/0171297 A1 9/2004 Hsu
2004/0171315 A1 9/2004 Liao
2004/0194585 A1 10/2004 Clark
2004/0224556 A1 11/2004 Qin
2005/0009379 A1 1/2005 Huang
2005/0020121 A1 1/2005 Lin
2005/0032410 A1 2/2005 Huang
2005/0070145 A1 3/2005 Huang
2005/0075012 A1 4/2005 Hsu
2005/0153587 A1 7/2005 Hsu
2005/0159030 A1 7/2005 Hsu
2005/0186852 A1 8/2005 Hsu
2005/0186853 A1 8/2005 Hsu
2005/0202690 A1 9/2005 Lien
2005/0202699 A1 9/2005 Hsu
2005/0233632 A1 10/2005 Hsu
2005/0250357 A1 11/2005 Chen
2005/0260894 A1 11/2005 Chen
2006/0094300 A1 5/2006 Hsu
2006/0110977 A1 5/2006 Matthews
2006/0121753 A1 6/2006 Chiang
2006/0121763 A1 6/2006 Chiang
2006/0292926 A1 12/2006 Chee
2007/0049113 A1 * 3/2007 Rodrigues ..... H01R 9/0524 439/578
2007/0087628 A1 * 4/2007 Rodrigues ..... H01R 13/5816 439/585
2007/0093127 A1 * 4/2007 Thomas ..... H01R 4/5033 439/578
2007/0093128 A1 * 4/2007 Thomas ..... H01R 9/0521 439/578
2008/0102696 A1 * 5/2008 Montena ..... H01R 9/05 439/578
2008/0216611 A1 9/2008 Resnick
2008/0248689 A1 * 10/2008 Montena ..... H01R 9/05 439/583
2009/0053931 A1 * 2/2009 Islam ..... H01R 9/05 439/578
2009/0098770 A1 4/2009 Bence
2009/0163075 A1 6/2009 Blew
2009/0176396 A1 * 7/2009 Mathews ..... H01R 9/0524 439/271
2009/0176407 A1 * 7/2009 Shaw ..... H01R 9/0521 439/584
2009/0181575 A1 * 7/2009 Hung ..... H01R 9/0521 439/583
2010/0021261 A1 * 1/2010 Bianchi ..... F16B 13/0875 411/78
2010/0081321 A1 4/2010 Malloy
2010/0081322 A1 * 4/2010 Malloy ..... H01R 13/187 439/578
2010/0112855 A1 * 5/2010 Paynter ..... H01R 9/0521 439/584
2010/0199813 A1 8/2010 Phillips
2010/0255720 A1 * 10/2010 Radzik ..... H01R 24/40 439/578
2010/0255721 A1 * 10/2010 Purdy ..... H01R 9/0521 439/583
2010/0273351 A1 * 10/2010 Holliday ..... H01R 9/0518 439/584
2011/0021072 A1 1/2011 Purdy
2011/0053413 A1 * 3/2011 Mathews ..... H01R 9/0524 439/578
2011/0065317 A1 * 3/2011 Shaw ..... H01R 9/0524 439/578
2011/0086543 A1 4/2011 Alrutz
2011/0111623 A1 * 5/2011 Burris ..... H01R 9/0524 439/578
2011/0117776 A1 * 5/2011 Burris ..... H01R 9/0524

(56) References Cited

U.S. PATENT DOCUMENTS

439/578
2011/0143586 A1* 6/2011 Ehret ..... H01R 13/622
439/584
2011/0180177 A1* 7/2011 Shaw ..... H01R 9/0524
141/1
2011/0230089 A1* 9/2011 Amidon ..... H01R 9/0524
439/578
2011/0230091 A1* 9/2011 Krenceski ..... H01R 9/0524
439/578
2011/0248801 A1 10/2011 Blake
2011/0250789 A1 10/2011 Burris
2011/0312199 A1* 12/2011 Alrutz ..... H01R 13/622
439/188
2012/0003869 A1 1/2012 Ehret
2012/0040537 A1* 2/2012 Burris ..... H01R 13/6581
439/11
2012/0045933 A1* 2/2012 Youtsey ..... H01R 9/05
439/578
2012/0083154 A1* 4/2012 Thomas ..... H01R 13/6277
439/585
2012/0094530 A1* 4/2012 Montena ..... H01R 9/0527
439/578
2012/0122329 A1* 5/2012 Montena ..... H01R 9/05
439/271
2012/0129387 A1* 5/2012 Holland ..... H01R 13/622
439/578
2012/0142215 A1* 6/2012 Rodrigues ..... H01R 9/05
439/578
2012/0171894 A1* 7/2012 Malloy ..... H01R 13/187
439/578
2012/0178289 A1* 7/2012 Holliday ..... H01R 9/0518
439/585
2012/0196476 A1* 8/2012 Haberek ..... H01R 9/05
439/578
2012/0202378 A1* 8/2012 Krenceski ..... H01R 9/0524
439/578
2012/0225581 A1* 9/2012 Amidon ..... H01R 9/0524
439/584
2012/0270428 A1* 10/2012 Purdy ..... H01R 9/0524
439/277
2013/0012063 A1* 1/2013 Thomas ..... H01R 9/0524
439/578
2013/0034983 A1* 2/2013 Purdy ..... H01R 9/0524
439/277
2013/0045627 A1* 2/2013 Purdy ..... H01R 24/40
439/578
2013/0065433 A1* 3/2013 Burris ..... H01R 13/6581
439/578
2013/0065435 A1* 3/2013 Purdy ..... H01R 9/0524
439/583
2013/0072057 A1* 3/2013 Burris ..... H01R 13/622
439/578
2013/0072059 A1* 3/2013 Purdy ..... H01R 9/0524
439/583
2013/0102188 A1* 4/2013 Montena ..... H01R 9/05
439/578
2013/0102189 A1* 4/2013 Montena ..... H01R 9/05
439/578
2013/0115811 A1* 5/2013 Ehret ..... H01R 9/05
439/578
2013/0115812 A1* 5/2013 Ehret ..... H01R 9/05
439/578
2013/0115813 A1* 5/2013 Ehret ..... H01R 9/05
439/583
2013/0130544 A1* 5/2013 Wei ..... H01R 13/405
439/584
2013/0137299 A1* 5/2013 Chastain ..... H01R 9/0527
439/583
2013/0164975 A1* 6/2013 Blake ..... H01R 13/652
439/578
2013/0164976 A1* 6/2013 Chastain ..... H01R 9/05
439/583
2013/0171869 A1* 7/2013 Chastain ..... H01R 13/512
439/583
2013/0171870 A1* 7/2013 Chastain ..... H01R 13/512
439/583
2013/0183857 A1* 7/2013 Ehret ..... H01R 9/05
439/578
2013/0224995 A1* 8/2013 Montena ..... H01R 9/05
439/583
2013/0237089 A1* 9/2013 Lu ..... H01R 9/0524
439/578
2013/0295793 A1* 11/2013 Shaw ..... H01R 9/0521
439/583
2013/0316577 A1* 11/2013 Wang ..... H01R 9/0521
439/583
2013/0330967 A1* 12/2013 Youtsey ..... H01R 9/0524
439/584
2013/0337683 A1* 12/2013 Chastain ..... H01R 9/0521
439/578
2014/0004739 A1 1/2014 Ehret
2014/0357119 A1* 12/2014 Chastain ..... H01R 9/0521
439/583
2014/0357120 A1* 12/2014 Blake ..... H01R 9/0521
439/583
2015/0033551 A1* 2/2015 Chastain ..... H01R 9/0527
29/828
2015/0162675 A1* 6/2015 Davidson, Jr. ..... H01R 9/0521
439/583
2015/0194747 A1* 7/2015 Shaw ..... H01R 9/0521
439/583

FOREIGN PATENT DOCUMENTS

WO WO9324973 12/1993
WO WO9620518 7/1996
WO WO9722162 6/1997
WO WO9965117 12/1999
WO WO9965118 12/1999
WO WO03096484 11/2003
WO WO2005083845 9/2005

OTHER PUBLICATIONS

PPC, 2008 Product Catalog, pp. A9,A10, PPC, East Syracuse, New York.

* cited by examiner

ENHANCED CONTINUITY CONNECTOR

PRIORITY APPLICATIONS AND INCORPORATION BY REFERENCE

This application is a continuation-in-part of U.S. patent application Ser. No. 14/035,872 filed Sep. 24, 2013 which is i) a continuation-in-part of U.S. patent application Ser. No. 13/527,521 filed Jun. 19, 2012 and ii) a continuation-in-part of U.S. patent application Ser. No. 13/374,378 filed Dec. 27, 2011 now U.S. Pat. No. 8,636,541, all of which are owned by the assignee of the instant application and all of which are now incorporated herein by reference in their entireties and for all purposes.

U.S. Pat. No. 7,841,896 issued Nov. 30, 2010 and U.S. Pat. No. 7,513,795 issued Apr. 7, 2009 are owned by the assignee of the instant application and are now incorporated herein by reference in their entireties and for all purposes.

BACKGROUND OF THE INVENTION

1. Field of the Invention

The present invention relates generally to coaxial cable connectors. More particularly, the present invention relates to coaxial F-connectors adapted to enhance electrical continuity.

2. Description of the Related Art

Cable television systems and satellite television receiving systems utilize coaxial cable and coaxial cable connectors for distributing signals. As is known in the industry, coaxial connectors such as "F-Type" connectors are commonly used to terminate lengths of coaxial cable. Where an "F" type connector terminates a coaxial cable, a mating connector typically interconnects a device such as a splitter, set top box, or a cable splice.

An electrical junction formed by mated F connectors may be referred to as a "male" F connector mated with a "female" F connector. Where a female F connector is mounted on an item of equipment such as a set top box, it may be referred to as a port. And, where a male F connector is used to terminate a coaxial cable, a common feature of the male connector is use of an attached coaxial cable center conductor as the central or signal contact that mates with a corresponding female connector contact.

Coaxial cable includes concentric conductors in the form of a center conductor spaced apart from a surrounding outer conductor by a dielectric layer. While the center conductor may be a single wire, the outer conductor typically includes a grounding sheath conductor such as tubular sheath formed from braided wire. The braided sheath may overlay yet another ground conductor(s) such as a metallic foil that covers the dielectric. The electrical junction made when F connectors are mated therefore includes a first junction interconnecting center conductors and a second junction interconnecting outer or ground conductors.

Male F-connectors typically include a central post, a body, and a nut. Some of these connectors may further include a means for immobilizing a coaxial cable within the body.

The post provides an electrical conductor for contacting the coaxial cable braid or sheath. A tubular post with an insertable shank that can slide between a coaxial cable's outer braid or sheath and dielectric serves this purpose. Frequently, the shank has a barbed insertable end for enhancing electrical contact and/or mechanical attachment.

The nut is rotatably engaged with the post via an enlarged post end or a post flange opposite the shank. Where the nut of a male F connector is properly threaded onto an F female connector, the enlarged post end is brought into contact with a mating ground conductor such as the metallic body of an F female port. Unreliable and/or intermittent continuity is frequently the result of a loose nut and a ground circuit passing poorly or not at all from the post to an F female port.

Reliable grounding through direct post to port contact requires proper installation techniques in mating male and female connectors. For example, where a male connector includes a threaded nut, proper tightening/torqueing of the nut onto a mating connector is required. When properly installed, the male connector post directly engages an outer conductor of a female connector such as a port ground terminal and a direct electrical connection is established between the post and the ground terminal. If the installer fails to accomplish this, it is doubtful that a reliable or dependable electrical grounding path will be established between the coaxial cable sheath and the female connector.

Notably, F connector installation problems may come to light only after the installer has left the site. For example, operation of the connection may initially be reliable but later become unreliable due to changes such as oxidation and/or deformation of connector metal parts. Further, unintended gaps between metallic parts in the connection invites radio frequency ("RF") signal ingress and egress that can interfere with or attenuate the signal the coaxial connection is intended to transport.

With growing demands of cable, satellite and broadband operators for more reliable signal distribution, it is, as stated by SCTE, "most desirable to have [connector] contact resistance as close to zero as possible." (ANSI/SCTE 103 2012 Test Method for DC Contact Resistance, Drop cable to "F" connectors and F 81 Barrels). Notably, this requirement should be met along with others as they may be applicable, for example a nominal 75 ohm impedance, environmental seals such as moisture sealing, service life measured in years, tolerance to wide temperature extremes, cable/connector insertion and retention forces, and in cases more. (SCTE-103-2004 (DC contact resistance): ANSI/SCTE 60-2004 (Moisture Migration test): ASTM-B117-03 (Salt Spray test): ANSI/SCTE-99-2004 (Axial Pull test): SCTE-98-2004 (Tightening Torque): SCTE-73-2002 (Coaxial Insertion Force): SCTE-48-3-2004 (Shielding Effectiveness): ANSI/SCTE-04-1997 (F Connector Return Loss): SBCA standards of Physical Dimension Tolerance: GR-1503-core, Issue 1, March 1995 UV degradation).

BRIEF SUMMARY OF THE INVENTION

In the present invention, a male F-Type coaxial cable connector includes a body with a body prod for urging a connector nut into contact with a connector post.

In an embodiment, a male F-Type coaxial cable connector comprises: a coaxially arranged nut, post, and plastic body; a post flange rotatably retaining the nut; the body having a leading end and a trailing end, the leading end fixedly engaging the post; a blocking ring carried by an end cap, the blocking ring for fixing a coaxial cable within the connector when the end cap is advanced over the body; a nut contactor integral with the body and proximate the body leading end; and, the nut contactor urging the nut into contact with the post flange; wherein the nut contactor includes a resilient tab and a pocket behind the tab, the pocket providing a tab deflection space for receiving the tab when it is deflected by a force the nut exerts on the tab; wherein the connector completes an electrical path between a coaxial cable outer conductor and a mating connector ground terminal via (i) contacting the outer conductor with the post, (ii) contacting the post with the nut, and (iii) contacting the nut with the ground terminal.

In various embodiments, additional features include one or more of the following. The tab contacts the nut via a tab finger that projects axially from a tab surface toward the nut. A plurality of the nut contactors, spaced apart and circumferentially arranged; and, body material isolating each pocket from adjacent pockets. A pocket aspect ratio apparent on a surface of the body has a value about equal to one. A tab has a trapezoidal shape. A radial line passing through a pocket bottom defines a body material thickness and a pocket depth, the pocket depth exceeding the body material thickness. A tab boundary includes a tab free end and but for the tab free end, the tab boundary is contiguous with the body. Body slots flanking generally opposed edges of the tab. The generally opposed tab edges, a tab free end, and a tab base substantially form a tab boundary. The tabs are radially tapered away from the tab base. A tab is axially thickest at its base. A tab slopes from its free end near a pocket top to its base near a pocket bottom, a pocket top axial dimension exceeding a pocket bottom axial dimension.

In another embodiment, a male F Type coaxial connector with a post and a nut retained by a post flange and a method of continuously urging movement of the nut along a connector central axis to abut the flange, the method comprising the steps of: providing a coaxially arranged connector body having a neck adjoining a sleeve, the neck encircling and fixed to the post; forming plural voids in the neck, each void isolated from adjacent voids by body material and each void between axially separated end portions of the neck; and urging axial movement of the nut to abut the flange via a nut abutment integral with the neck.

In various embodiments, additional features include one or more of the following. The voids are evidenced by respective holes in an outer surface of the neck. The nut abutment presents a smooth surface where it contacts the nut.

Notably, selected embodiments of the present invention may provide one or more of: proper continuity in a coaxial connector, even though torque requirements have been ignored; reliable continuity between a connector and a socket or port, even if the connector is not fully tightened; a compressible coaxial cable connector which establishes and maintains reliable electrical continuity; a coaxial connector that can be manufactured economically; a connector of the character described that establishes satisfactory EMI and RFI shielding; a connector of the character described that establishes reliable continuity between critical parts during installation of the male connector to the various types of threaded female connections, even though applied torque may fail to meet specifications; a proper ground electrical path with a socket even where the male connector is not fully torqued to the proper settings; minimized resistive losses in a coaxial cable junction; operation with bandwidth approximating three GHz; an F-connector adapted for home satellite and cable systems distributing multiple, high definition television channels; a connector of the character described that is weather proof and moisture resistant; and, a compression F-connector of the character described that can be safely and properly installed without deformation of critical parts during final compression.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

DETAILED DESCRIPTION

The disclosure provided herein describes examples of some embodiments of the invention. The designs, figures, and descriptions are non-limiting examples of the embodiments they disclose. For example, other embodiments of the disclosed device and/or method may or may not include all of the features described herein. Moreover, disclosed advantages and benefits may apply to only certain embodiments of the invention and should not be used to limit the disclosed invention.

Figure 1:
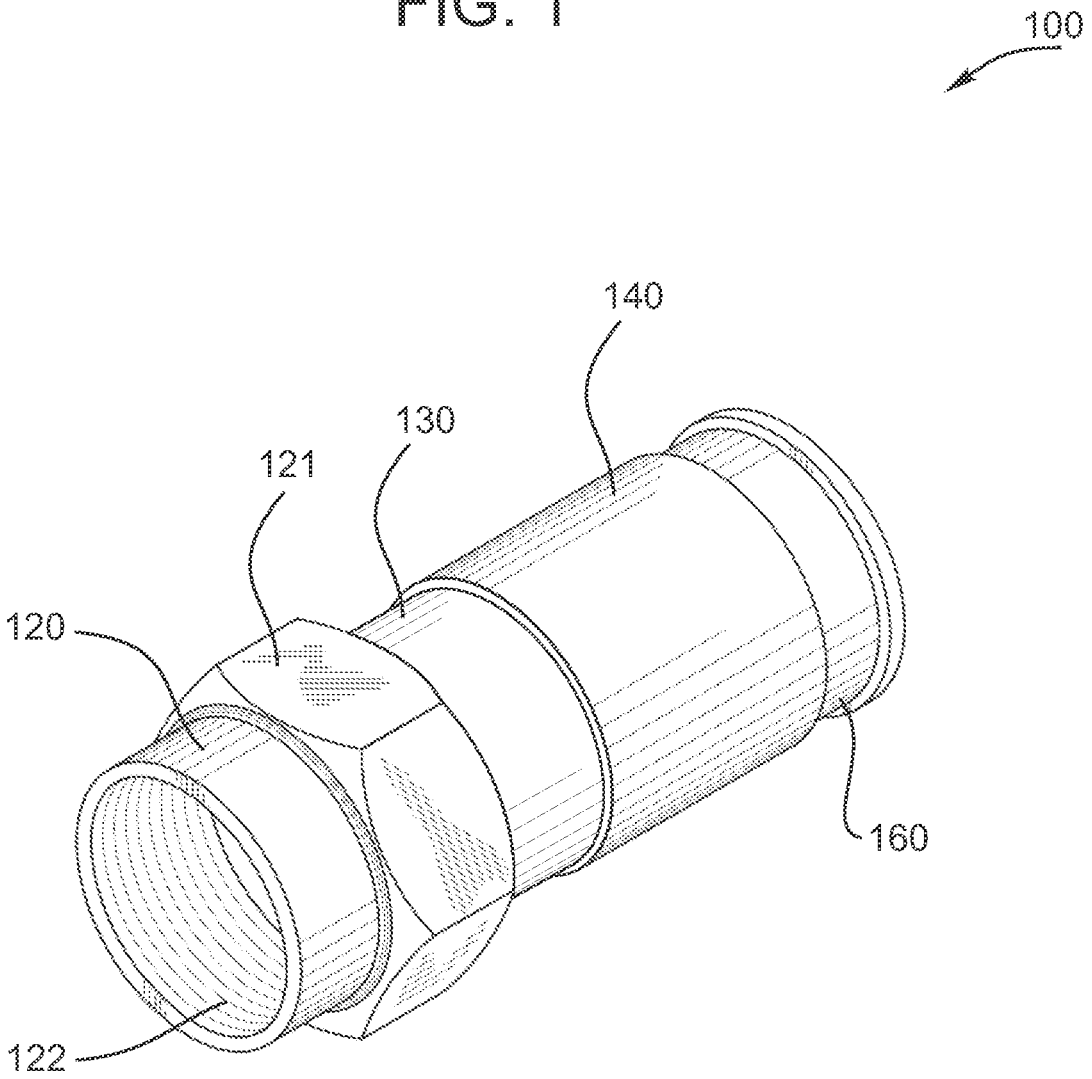
FIG. 1 is a perspective front view of an enhanced continuity connector in accordance with an embodiment of the present invention.
Figure 2:
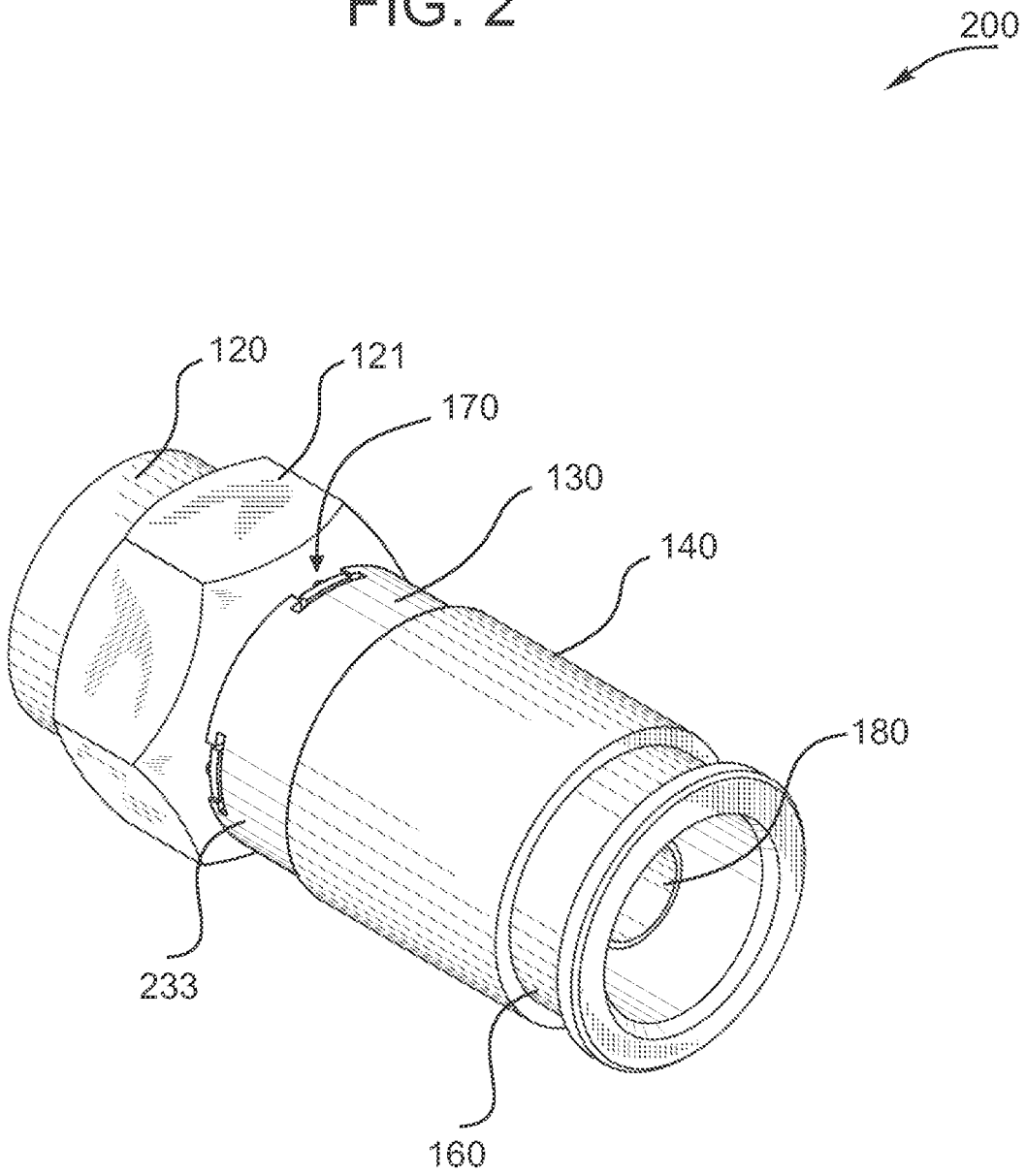
FIG. 2 is a perspective rear view of the connector of FIG. 1.

FIG. 1 shows a perspective front view 100 of a male F-Type connector of the present invention. FIG. 2 shows a perspective rear view 200 of the same connector.

FIGS. 1-2 show connector parts including a connector fastener such as a nut 120 with internal threads 122, a connector body 130, and an end cap 140. The nut may include peripheral flats 121 for grasping and turning/torqueing the nut with a wrench. And, the end cap may include an outer circumferential groove 160 for receiving a marker or identification band. In various embodiments the nut and end cap incorporate or are made from conductive material(s) including metals such as brass or copper alloys.

Visible in the rear view of FIG. 2 is a nut contactor 170. The contactor is proximate a forward end of the body 233 and in some embodiments is integral with the body. Embodiments of the contactor and/or body may incorporate or be made from non-conductive material(s) including polymers such as a resilient plastic.

Concerning application with various coaxial cable sizes and structures, the connector 100 may be designed to accommodate different coaxial cables. For example, embodiments of the connector may be used to terminate Series-6, Series-59, and other coaxial cables with varying structures such as dual-shields, tri-shields, and quad-shields.

Figure 3:
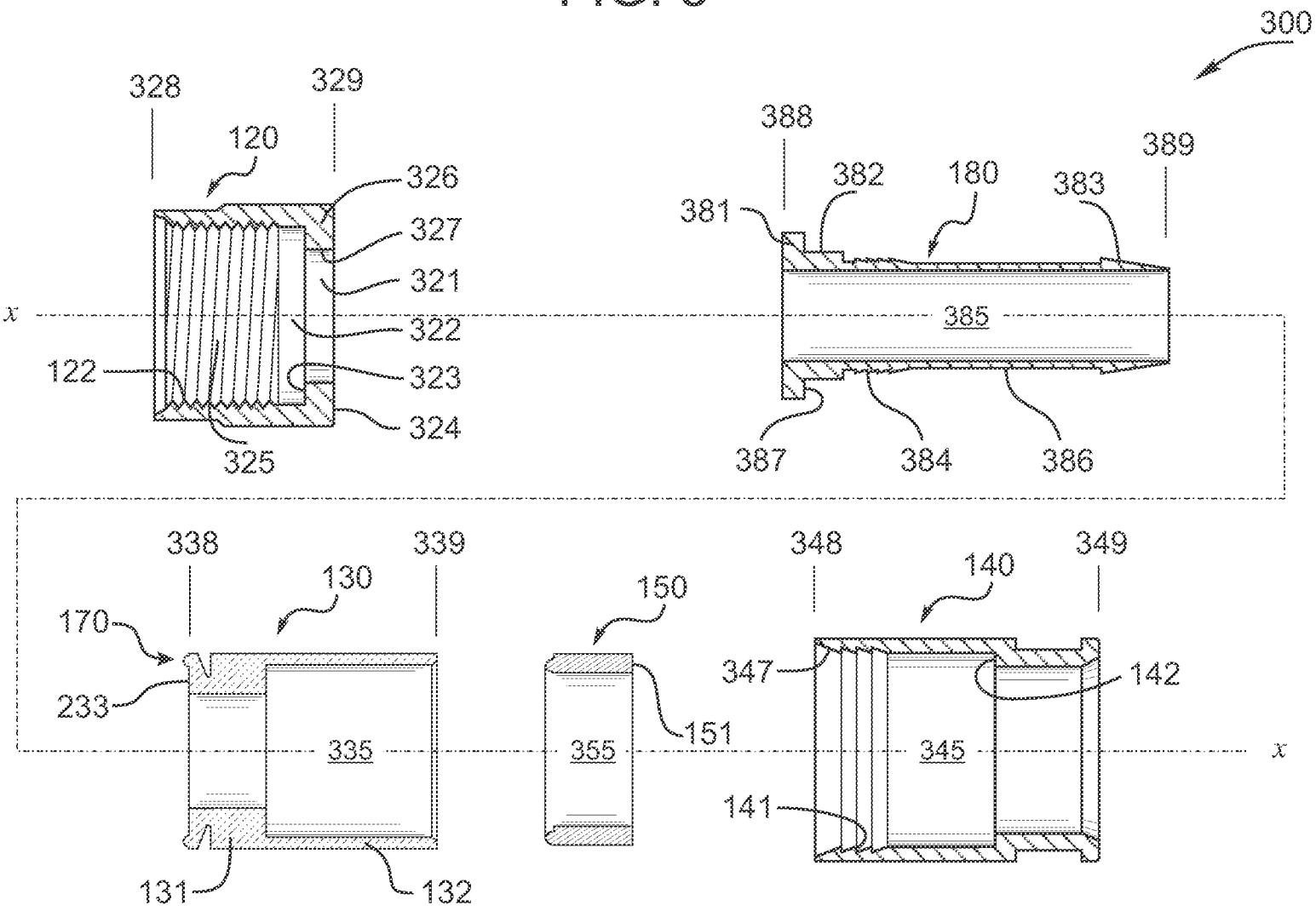
FIG. 3 is an cross-sectional exploded view of the connector of FIG. 1.
Figure 4A:
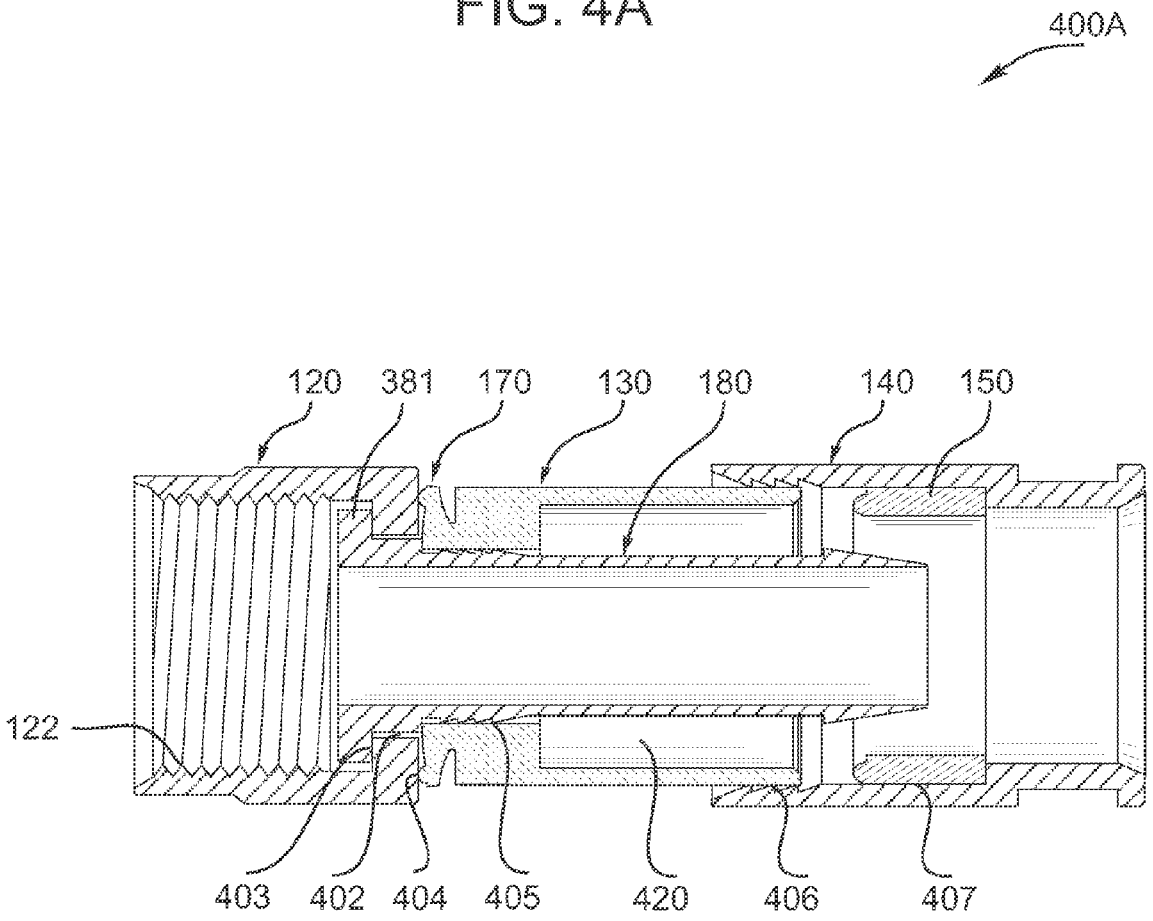
FIGS. 4A-E show embodiments of the connector of FIG. 1.

FIGS. 3, 4A show an exploded view 300 and a cross-sectional side view 400A of the connector of FIG. 2. Connector parts include a nut 120, body 130, and post 180. Various embodiments also include an end cap 140 and a ring 150. Each of these parts is concentrically arranged about a longitudinal or central axis x-x and may be referred to as having a leading end or end portion and a trailing end or end portion with respect to the axis.

The tubular post 180 is for engaging the rotatable nut 120 and the body 130 while the end cap 140 is for engaging the body 130. In an assembled connector, interfaces among these parts may include one or more of a longitudinal nut-post interface 402, a radial nut-post interface 403, a body-nut interface 404, a body-post interface 405, an end cap-body interface 406, and an end cap-ring interface 407.

The post 180 extends between leading and trailing ends 388, 389 defining a hollow interior 385 therebetween. A nut retainer such as an enlarged end part or flange 381 adjoins a post shank 386. In various embodiments, the post trailing end includes a radial projection such as a barb 383 for enhancing mechanical and/or electrical engagement with a coaxial cable.

Features of the post may include, behind the enlarged end portion 381, nut-post and body-post interface portions such as a circumferential post shoulder 382 and an adjacent body engagement 384 with an upset or roughened outer surface.

The nut 120 extends between leading and trailing ends 328, 329 and defines a hollow interior 325 therebetween. The nut is for rotatable engagement with the post 180 and the post enlarged end 381 is for retaining the nut while enabling the nut to rotate about the post.

Features of the nut may include, near the nut trailing end, a nut-post interface portion such as an inwardly directed flange or rim 326 and near the nut leading end a female F connector interface such as a nut mouth or a threaded nut mouth 122. In various embodiments the nut includes a nut-post interface portion formed by nut cavity 322 surfaces that lie between the threads 122 and rim 326. For example, nut cavity surfaces may include an internal nut rim surface 323 and a nut sidewall surface 327.

The body 130 extends between leading and trailing ends 338, 339 and defines a hollow interior 335 therebetween. The body is for fixed engagement with the post 180 and for forming an annular space between the body and the post 180.

Features of the body may include a body neck 131 near the body leading end 338 that forms a portion of the body-post interface and an adjacent body sleeve 132 terminating at the body trailing end 339. In various embodiments, a radial (about perpendicular to the longitudinal axis x-x) wall thickness of the body neck is greater than a radial wall thickness of the body sleeve.

In various embodiments, a connector part such as the body 130 is designed to push the nut 120 against the post 180. For example, a leading body end 338 that is resilient and abuts a nut rearward facing nut surface 324 may serve to urge the nut into contact with the post at a post surface such as a rearward facing surface of the enlarged post end 387. In some embodiments, a nut contactor integral with the body 170 provides a means such as spring-like means for urging of the nut against the post.

The end cap 140 extends between leading and trailing ends 348, 349 and defines a hollow interior 345 therebetween. The end cap leading end is for sliding over the body trailing end 339. In various embodiments, the end cap is for internally carrying a ring such as a sealing, blocking, and/or compressing ring 150 having a ring interior 355.

Features of the end cap 140 may include a grasping mouth 141 at the leading end 348 and an inwardly directed shoulder 142 near the trailing end 349. The grasping mouth may include sloped ridges 347 projecting toward the axis x-x and providing a means for fixing the end cap in a final position on the body when the end cap is fully advanced onto the body to fix a coaxial cable therein. During advancement, the inwardly directed end cap shoulder pushes the ring 150 via a trailing ring face 151 toward the nut 120, for example into an annular space formed between the post 180 and the body 130 of an assembled connector.

Figure 4B:
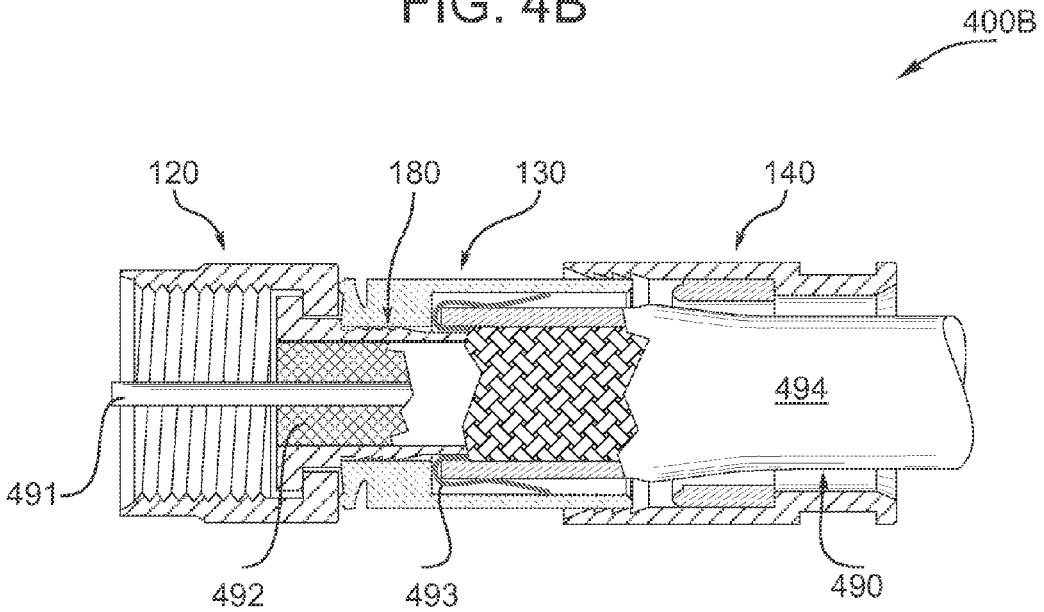
Figure 4C:
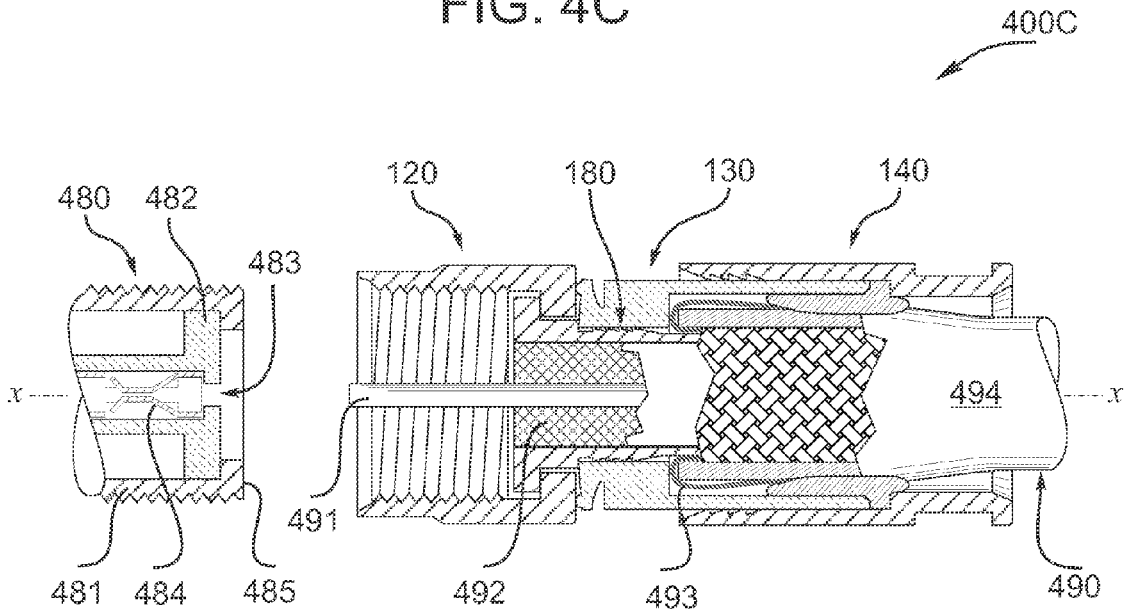

FIGS. 4B-C show cross-sectional side views 400B, 400C of a coaxial cable inserted in the connector of FIG. 4A. FIG. 4B shows a prepared end of a coaxial cable 490 is inserted in the connector before the end cap 140 is advanced on the body 130. As seen, the coaxial cable includes a dielectric 492 encircling a center conductor 491. The dielectric is encircled by a conductive outer braid or sheath 493 and an outermost jacket 494 such as a plastic or PVC jacket encircles the sheath. Notably, when the coaxial cable is inserted in the connector, an end of the connector post such as a barbed end 383 is inserted into the end of the coaxial cable between the dielectric layer 492 and the sheath outer conductor 493 such that a post hollow space 385 receives the coaxial cable center conductor and dielectric.

As shown in FIG. 4C, the prepared end of a coaxial cable 490 is fixed in the connector when the end cap 140 is advanced on the body 130 such that the ring 150 is pushed into the annular body space 420 and presses the coaxial cable sheath 493 against the post 180.

Shown adjacent to the F male connector is an F female connector portion including an outer metal case providing a case or a signal ground 481 and an internal center contact 484 for receiving a coaxial cable center conductor. In various embodiments, the case may be threaded 480. Access to the internal center contact is typically via an aperture 483 of an insulator 482 fixed at an end of the metal case 485.

As skilled artisans will appreciate, electrical continuity between the coaxial cable sheath 493 and the female connector metal case or ground 485 requires an electrical junction between the post 180 and the case 481. In particular, a first continuity path from the post 180 to the case 481 is required unless a second continuity path such as a continuity path from the post 180 to the nut 120 to the case 481 exists. Moreover, this second continuity path post-nut-case may be adapted to reliably provide continuity when the post-case continuity path is unreliable, for example due to improper coaxial connector mating.

Figure 4D:
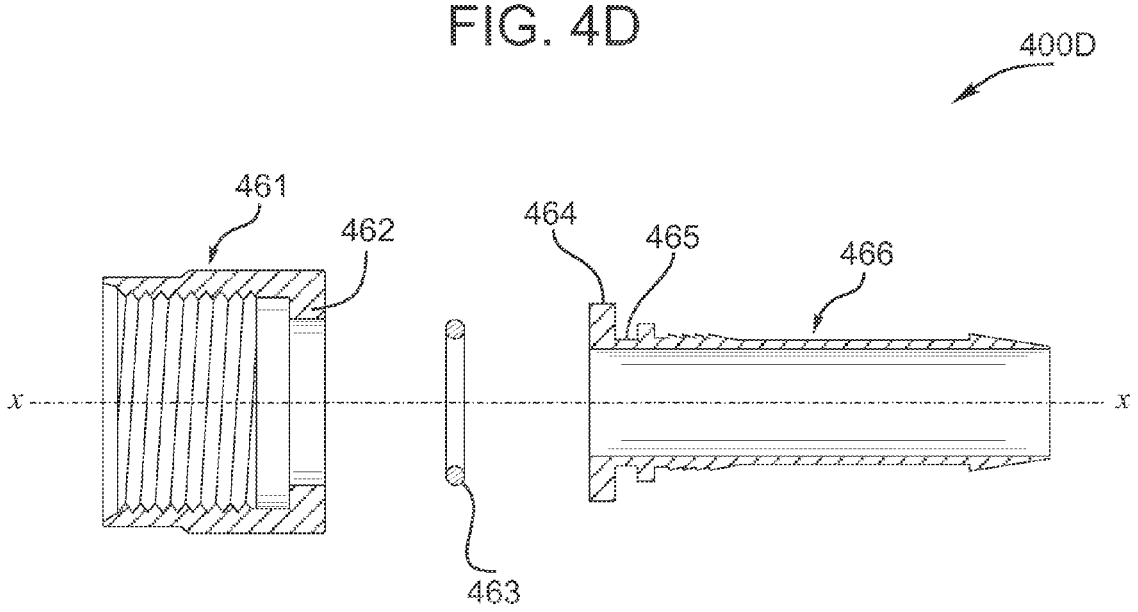
Figure 4E:
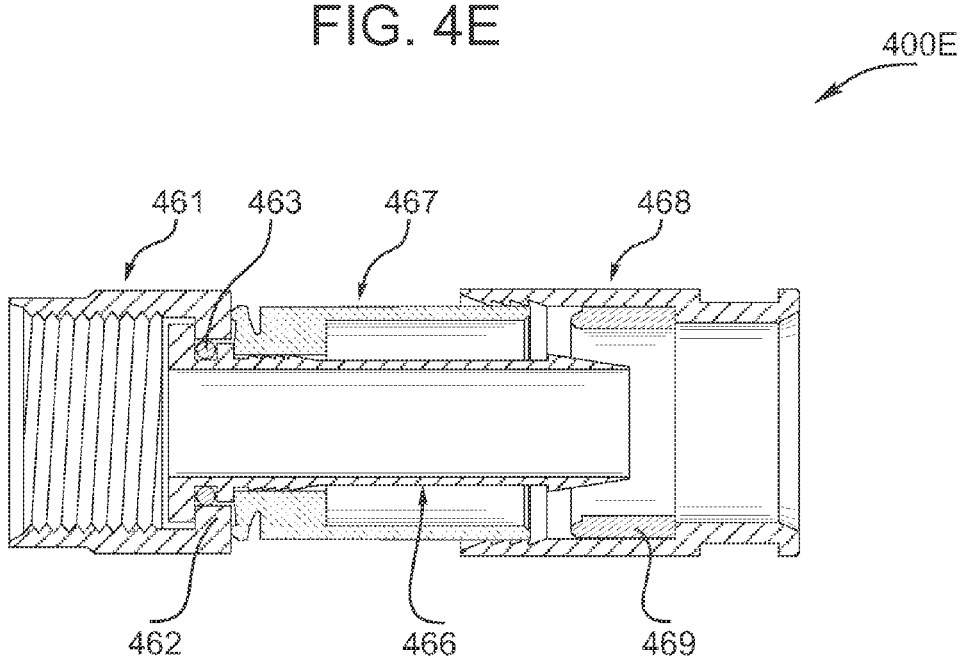

FIGS. 4D-E show connector parts and a connector 400D-E similar to the connector parts and connector of FIGS. 3, 4A. In particular, the connector parts of FIG. 4D include a nut 461, a post 466 with a post flange 464, a body 467, and end cap 468, and a sealing, blocking, or compression ring 469. Also shown is a second ring 463. Located in a groove 465 behind the post flange, the second ring is for mating with an inwardly turned rim 462 of the nut 461. In various embodiments, the second ring is an elastomeric or plastic O-Ring and in various embodiments the ring is for sealing between the nut and the post. Notably, any of the bodies discussed herein may be used with the connector of FIG. 4E.

Figure 5A:
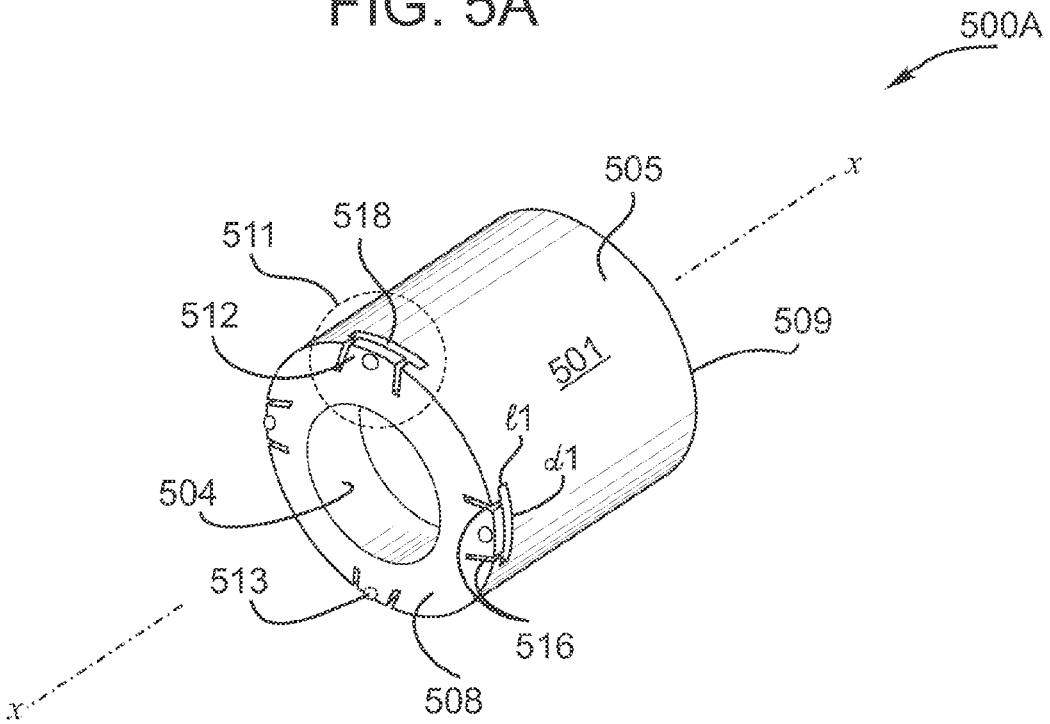
FIGS. 5A-D show views of a body for use with the connector of FIG. 1.
Figure 5B:
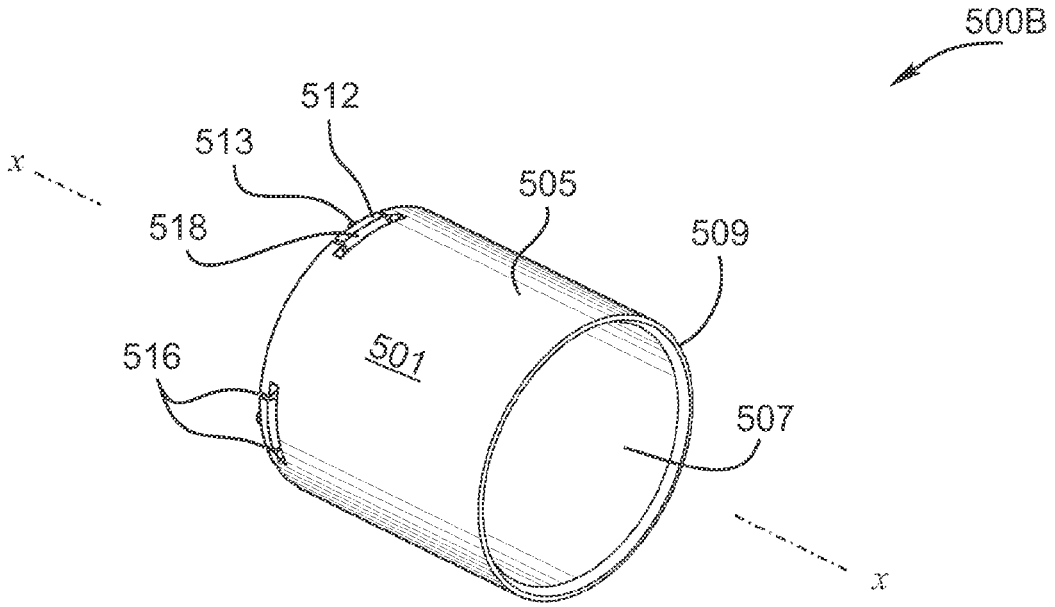

FIGS. 5A-B show perspective front and rear views of a body 500A-B for use with the connector of FIG. 1. The body 501 includes a leading or neck portion 504 adjoining a trailing or sleeve portion 505. Located between a body leading end or end portion 508 and a body trailing end or end portion 509 is hollow space 507 defined by the body. In various embodiments, the body is adapted to push against an adjacent fastener such as a nut 120.

Features of the body may include one or more nut contactors such as a group of circumferentially arranged nut contactors 511. In various embodiments, a nut contactor includes a deflectable prod portion such as a deflecting arm or tab 512. The deflectable prod portion is for pushing an adjacent nut 120 directly, or indirectly. Indirect pushing means may include a tab projection such a finger 513 that extends axially x-x as from a tab surface to contact a nut 120. In some embodiments, three or four nut contactors located near the body leading end 508 are equally circumferentially spaced for, inter alia urging non-binding movement of the nut along a post 180.

Where the body 501 is made from a suitably resilient material, deflection may be provided by compression of the body material. Deflection may also be provided by a thinned body part that deflects or bends. For example, the tab 512 of FIG. 5A is a thinned body part that extends from a tab base 524, between generally opposed body slots 516, to an opposed tab free end 522 (see also FIGS. 5C-D).

A body relief void 518 formed where body material behind the tab has been removed provides a deflection space or pocket for the tab. And in embodiments having plural tabs and respective pockets, each of the pockets may be isolated as by body material from adjacent pockets. Skilled artisans will appreciate less force is required to deflect this tab 512 than is required to compress the body 130 material.

An aspect ratio of the void 518 in a body outer surface is shown with lengths d1 by l1. Where d1 is large as compared with l1, a narrow void is formed. And, where d1 is not large as compared with l1, a void that is not narrow is formed. For example, a narrow aspect ratio exists when d1 is about three or more times greater than l1 and an aspect ratio that is not narrow exists when l1 is about equal to or greater than d1.

Figure 5C:
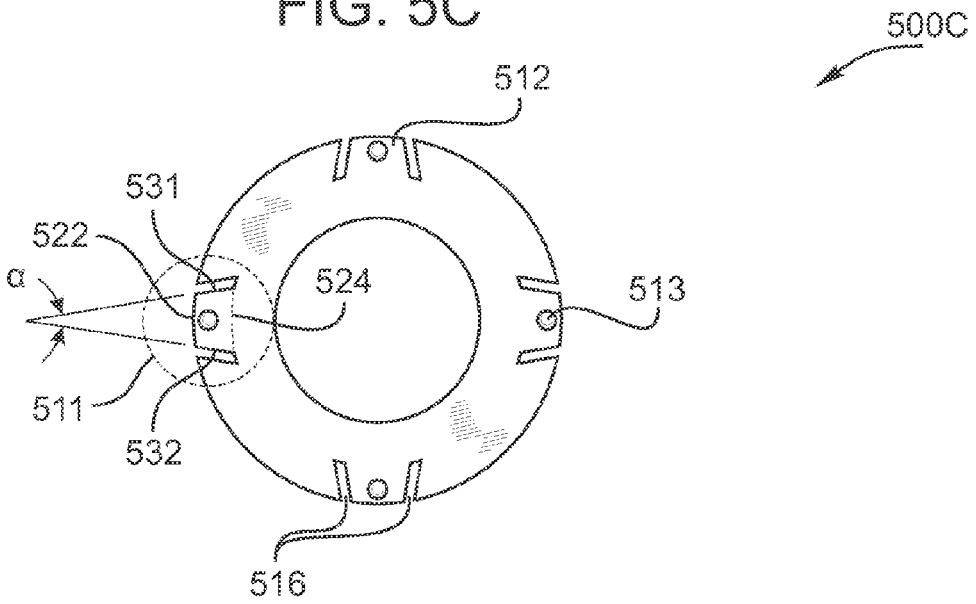

FIG. 5C shows a front view 500C of the body of FIG. 5A. In the figure, each of four nut contactors 511 includes a corresponding tab 512 and each tab is bordered by a base 524, a free end 522, and generally opposed sides 531, 532. The generally opposed sides define an angle $\alpha$ therebetween. In the embodiment shown, the tab's shape is similar to that of a trapezoid. In other embodiments, the tab shape may be curved, semicircular, rectangular or another suitable shape.

Figure 5D:
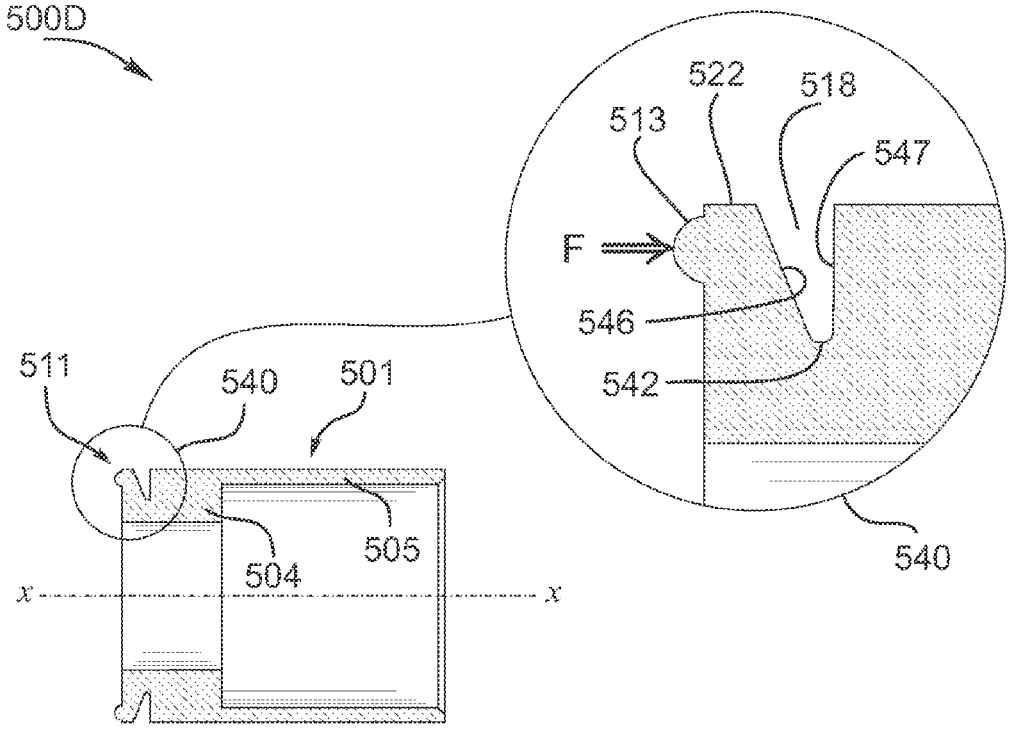

FIG. 5D shows side cross-sectional view 500D of the body of FIG. 5A. Here, the body 501 is shown including a neck 504 and a sleeve 505 trailing from the neck. An enlarged view 540 of a nut contactor 511 illustrates an embodiment of the relief void 518 that provides a deflection space for a tab 512 deflected by an opposing force F such as a force the nut 120 exerts on the tab. As seen, the void extends between a root 542 and a location near the tab free end 522.

The void 518 has generally opposed leading and trailing side walls 547, 546 adjoining the root 542 and the sidewalls may be smooth (as shown) or otherwise. The sidewalls may be parallel or not, for example not parallel as shown to accommodate greater deflection. The root may be radiused or not, for example radiused as shown to mitigate body 501 cracks. In some alternative embodiments, the void is a radial through-hole of a suitable cross-section.

In some embodiments the tab is radially tapered or reduced, for example thicker along a line parallel to the x-x axis at the tab base (see e.g. FIG. 5D) and/or for example thicker along a line perpendicular to the x-x axis at the tab base (see e.g. FIG. 5C).

Figure 6A:
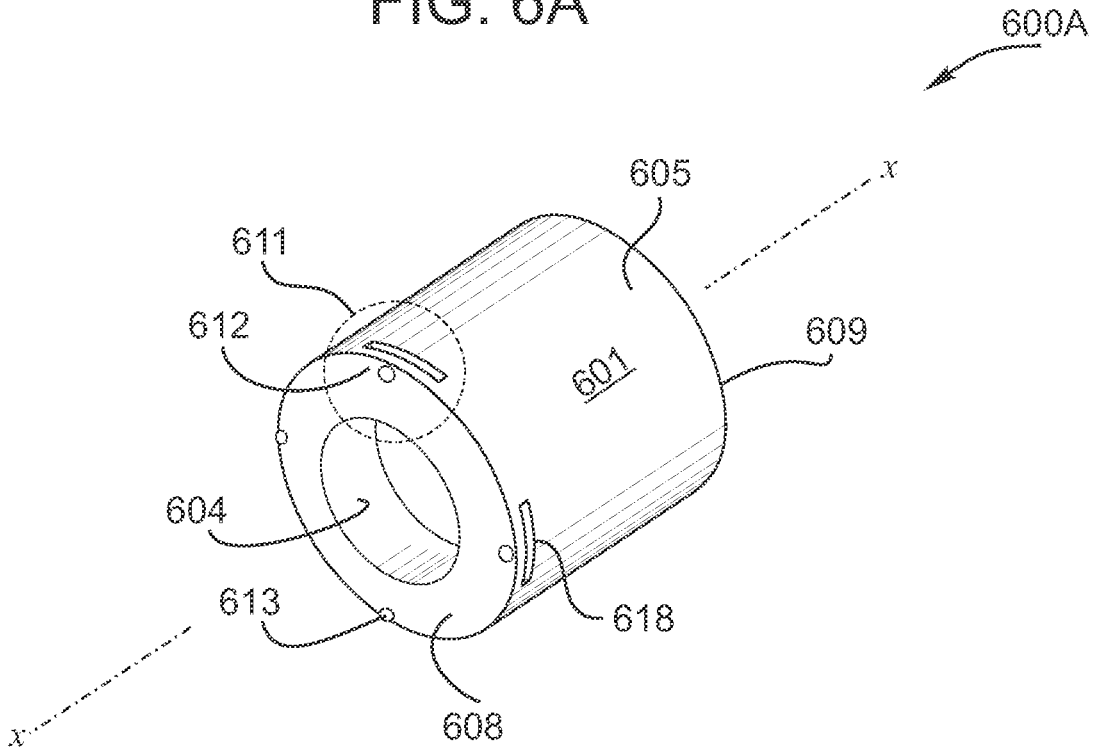
FIGS. 6A-C show views of another body for use with the connector of FIG. 1.
Figure 6B:
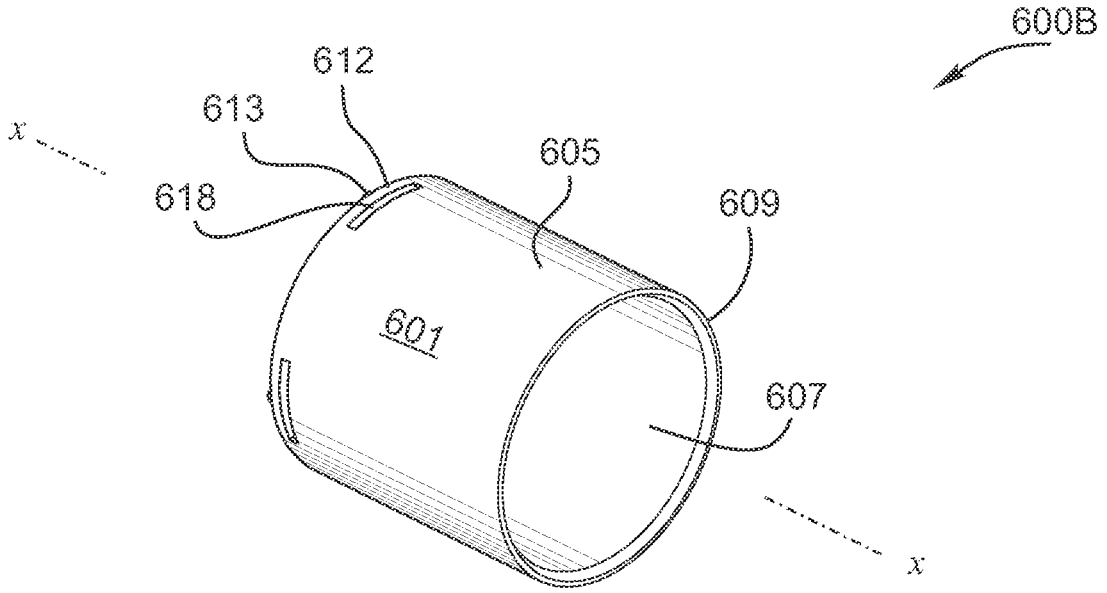

FIGS. 6A-B show perspective front and rear views of another body 600A-B for use with the connector of FIG. 1. The body 601 includes a leading or neck portion 604 adjoining a trailing or sleeve portion 605. Located between a body leading end or end portion 608 and a body trailing end or end portion 609 is hollow space 607 defined by the body. In various embodiments, the body is adapted to push against an adjacent fastener such as a nut 120.

Features of the body may include one or more nut contactors such as a group of circumferentially arranged nut contactors 611. In various embodiments, a nut contactor includes a deflectable prod portion such as a deflecting diaphragm or tab 612. The deflectable prod portion is for pushing an adjacent nut 120 directly, or indirectly. Indirect pushing means may include a tab projection such a finger 613 that extends axially x-x to contact a nut 120. In some embodiments three or four nut contactors located near the body leading end 608 are equally circumferentially spaced for, inter alia urging non-binding movement of the nut along a post 180.

Where the body 601 is made from a suitably resilient material, deflection may be provided by compression of the body material. Skilled artisans will recognize that connector bodies having voids or pockets beneath a body end facing the nut provides a means of controlling the compressibility of all or a portion, such as a peripheral portion, of the body end.

Deflection may also be provided by a thinned body part that deflects or bends. For example, the tab 612 of FIG. 6A is a thinned body part similar in some respects to the tab 512 of FIG. 5A. However, unlike the tab of FIG. 5A, the tab of FIG. 6A does not have slots 516 as boundaries. Skilled artisans will appreciate less force is required to deflect this tab 612 than is required to compress the body 130 material.

A body relief void 618 formed where body material behind the tab has been removed provides a deflection space or a pocket for the tab. And in embodiments having plural tabs and respective pockets, each of the pockets may be isolated from adjacent pockets. Because the tab has no slot boundaries 516, the relief void is surrounded by a continuous sidewall shown here as a tube of somewhat rectangular cross-section radiating from the longitudinal connector axis x-x.

Figure 6C:
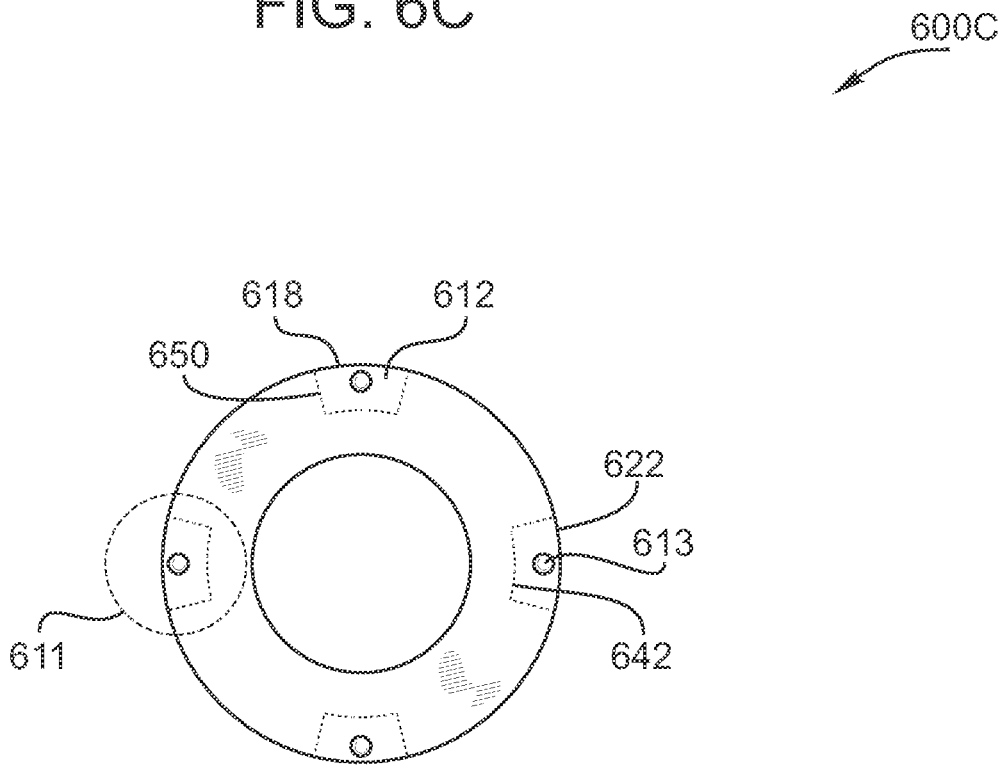

FIG. 6C shows a front view 600C of the body of FIG. 6A. In the figure, each of four nut contactors 611 includes a corresponding tab 612. Hidden lines 650 of the relief void 618 indicate a tab outline shown here as somewhat trapezoidal in shape. In other embodiments, tab shapes may be curved, semicircular, rectangular or another suitable shape.

In various embodiments, the void extends between a root 642 and a location near a tab free end 622. The void sidewalls may be parallel or not, for example not parallel to accommodate greater deflection. The root may be radiused or not, for example radiused as shown to mitigate body 601 cracks. In some alternative embodiments, the void is a radial through-hole of a suitable cross-section.

Embodiments of F male coaxial cable connectors e.g. 100 of the present invention enhance continuity of an electrical path through the connector. For example, where continuity from a) the sheath 493 of a coaxial cable 490 fitted to a male connector to b) a mated female connector case or ground 481 via direct post 180 to case contact is unreliable, a nut contactor 170 such as a nut contactor integral with the body provides sheath to case continuity by pushing an electrically conductive nut into contact with an enlarged post end 381 irrespective of whether the male connector is properly fitted and/or tightened onto a mating connector.

Where the nut contactor 170 is continuously pushing against the nut 120, skilled artisans will appreciate the need to choose nut materials, nut contactor materials and geometry, and interengaging forces therebetween to manage friction resisting nut rotation to industry acceptable levels while maintaining sufficient force for engaging the nut and post 180 to assure reliable nut to post electrical continuity.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A male F-Type coaxial cable connector comprising:
a coaxially arranged nut, post, and plastic body;
a post flange rotatably retaining the nut;
the body having a leading end and a trailing end, the leading end fixedly engaging the post;
an end cap;
a nut contactor integral with the body and proximate the body leading end; and,
the nut contactor urging the nut into contact with the post flange;
wherein the nut contactor includes a resilient tab and a pocket behind the tab, the pocket providing a tab deflection space for receiving the tab when it is deflected by a force exerted on the tab by the nut.

2. The connector of claim 1 wherein the tab contacts the nut via a tab finger that projects axially from a tab surface toward the nut.

3. The connector of claim 1 further comprising:
a plurality of the nut contactors, spaced apart and circumferentially arranged; and,
body material isolating each pocket from adjacent pockets.

4. The connector of claim 3 wherein a pocket aspect ratio apparent on a surface of the body has a value about equal to one.

5. The connector of claim 3 wherein the tab has a trapezoidal shape.

6. The connector of claim 3 wherein at a radial line passing through a pocket bottom indicates a body material thickness and a pocket depth, the pocket depth exceeding the body material thickness.

7. The connector of claim 3 wherein a tab boundary includes a tab free end and except for the tab free end, the tab boundary is contiguous with the body.

8. The connector of claim 3 further comprising:
body slots flanking generally opposed edges of the tab.

9. The connector of claim 8 wherein the generally opposed tab edges, a tab free end, and a tab base substantially form a tab boundary.

10. The connector of claim 9 wherein the tabs are radially tapered away from the tab base.

11. The connector of claim 10 wherein a tab is axially thickest at its base.

12. The connector of claim 9 wherein a tab slopes from its free end near a pocket top to its base near a pocket bottom, a pocket top axial dimension exceeding a pocket bottom axial dimension.

13. In a male F Type coaxial connector with a post and a nut retained by a post flange, a method of continuously urging movement of the nut along a connector central axis to abut the flange, the method comprising the steps of:
providing a coaxially arranged connector body having a neck adjoining a sleeve, the neck encircling and fixed to the post;
forming plural voids in the neck, each void isolated from adjacent voids by body material and each void between axially separated end portions of the neck; and,
urging axial movement of the nut to abut the flange via a nut abutment integral with the neck.

14. The method of claim 13 wherein the voids are evidenced by respective holes in an outer surface of the neck.

15. The method of claim 13 wherein the nut abutment presents a smooth surface where it contacts the nut.

16. A male F-Type coaxial cable connector comprising:
a coaxially arranged nut, post, and plastic body;
a post flange rotatably retaining the nut;
the body having a leading end and a trailing end, the leading end fixedly engaging the post;
a blocking ring carried by an end cap, the blocking ring for fixing a coaxial cable within the connector when the end cap is advanced over the body;
a nut contactor integral with the body and proximate the body leading end; and,
the nut contactor urging the nut into contact with the post flange;
wherein the nut contactor includes a resilient tab and a pocket behind the tab, the pocket providing a tab deflection space for receiving the tab when it is deflected by a force the nut exerts on the tab;
wherein the connector completes an electrical path between a coaxial cable outer conductor and a mating connector ground terminal via (i) contacting the outer conductor with the post, (ii) contacting the post with the nut, and (iii) contacting the nut with the ground terminal.

17. The connector of claim 16 wherein the tab contacts the nut via a tab finger that projects axially from a tab surface toward the nut.

18. The connector of claim 16 further comprising:
a plurality of the nut contactors, spaced apart and circumferentially arranged; and,
body material isolating each pocket from adjacent pockets.

19. The connector of claim 18 wherein a pocket aspect ratio apparent on a surface of the body has a value about equal to one.

20. The connector of claim 18 wherein a tab boundary includes a tab free end and but for the tab free end, the tab boundary is contiguous with the body.

21. The connector of claim 18 further comprising:
body slots flanking generally opposed edges of the tab.

* * * * *